US009027639B2

(12) United States Patent
Jaaskelainen et al.

(10) Patent No.: US 9,027,639 B2
(45) Date of Patent: May 12, 2015

(54) SAND CONTROL SCREEN ASSEMBLY WITH INTERNAL CONTROL LINES

(71) Applicant: Halliburton Energy Services, Inc., Houston, TX (US)

(72) Inventors: Mikko Jaaskelainen, Katy, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/363,335

(22) PCT Filed: Jul. 8, 2013

(86) PCT No.: PCT/US2013/049523

§ 371 (c)(1),
(2) Date: Jun. 6, 2014

(87) PCT Pub. No.: WO2015/005893

PCT Pub. Date: Jan. 15, 2015

(65) Prior Publication Data

US 2015/0013970 A1 Jan. 15, 2015

(51) Int. Cl.

| | |
|---|---|
| ***E21B 43/08*** | (2006.01) |
| ***E21B 47/06*** | (2012.01) |
| ***E21B 47/12*** | (2012.01) |
| *E21B 43/12* | (2006.01) |

(52) U.S. Cl.

CPC ..... *E21B 47/123* (2013.01); *E21B 47/06* (2013.01); *E21B 43/08* (2013.01); *E21B 47/065* (2013.01); *E21B 43/12* (2013.01)

(58) Field of Classification Search

CPC ..... E21B 43/08; E21B 43/04; E21B 43/108; E21B 43/12; E21B 47/00

See application file for complete search history.

(56) References Cited

U.S. PATENT DOCUMENTS

| | | | | |
|---|---|---|---|---|
| 6,983,796 | B2 * | 1/2006 | Bayne et al. | 166/278 |
| 8,252,729 | B2 | 8/2012 | Zhang | |
| 2004/0149435 | A1 | 8/2004 | Henderson | |
| 2004/0173352 | A1 | 9/2004 | Mullen et al. | |
| 2004/0262011 | A1 | 12/2004 | Huckabee et al. | |
| 2011/0297376 | A1 | 12/2011 | Holderman et al. | |

FOREIGN PATENT DOCUMENTS

| | | | |
|---|---|---|---|
| WO | 2012122336 | A1 | 9/2012 |
| WO | 2015005893 | A1 | 1/2015 |

OTHER PUBLICATIONS

International Search Report and Written Opinion for PCT/US2013/049523 dated Mar. 27, 2014.

* cited by examiner

*Primary Examiner* — Zakiya W Bates
(74) *Attorney, Agent, or Firm* — McDermott Will & Emery LLP; Scott Richardson

(57) ABSTRACT

Disclosed are sand control screens and completion assemblies that receive, retain, and protect control lines during installation and operation thereof. One disclosed completion assembly includes a base pipe, at least one screen jacket positioned around the base pipe and operable to prevent an influx of particulate matter of a predetermined size therethrough, a control line housing arranged uphole from the at least one screen jacket and having a fiber optic splicing block disposed therein, the at least one fiber optic splicing block being communicably coupled to a control line that extends uphole from the control line housing, and one or more hydraulic conduits arranged longitudinally between the at least one screen jacket and the base pipe and extending from the control line housing.

21 Claims, 5 Drawing Sheets

SAND CONTROL SCREEN ASSEMBLY WITH INTERNAL CONTROL LINES

This application is a National Stage entry of and claims priority to International Application No. PCT/US2013/049523, filed on Jul. 8, 2013.

BACKGROUND

This present disclosure is related to wellbore operations and, more particularly, to sand control screen assemblies that receive, retain, and protect control lines during installation and operation of the sand control screen assembly.

During hydrocarbon production from subsurface formations, efficient control of the movement of unconsolidated formation particles into the wellbore, such as sand, has always been a pressing concern. Such formation movement commonly occurs during production from completions in loose sandstone or following the hydraulic fracture of a formation. Formation movement can also occur suddenly in the event a section of the wellbore collapses, thereby circulating significant amounts of particulates and fines within the wellbore. Production of these unwanted materials may cause numerous problems in the efficient extraction of oil and gas from subterranean formations. For example, producing formation particles may tend to plug the formation, tubing, and subsurface flow lines. Producing formation particles may also result in the erosion of casing, downhole equipment, and surface equipment. These problems lead to high maintenance costs and unacceptable well downtime.

Numerous methods have been utilized to control the movement or production of these unconsolidated formation particles during production operations. For example, one or more sand control screen assemblies are commonly included in the completion string to regulate and restrict the movement of formation particles. Such sand control screen assemblies are commonly constructed by installing one or more screen jackets on a perforated base pipe. The screen jackets typically include one or more drainage layers, one or more screen elements such as a wire wrapped screen or single or multilayer wire mesh screen, and a perforated outer shroud.

Smart well components are also often installed with sand control screen assemblies to enable the management of downhole equipment and production fluids. Such smart well components can include one or more sensing devices such as temperature sensors, pressure sensors, flow rate sensors, fluid composition measurement devices, or the like. Other smart well components include control mechanisms, such as flow control devices, safety devices, and the like. These smart well systems are typically controlled or communicated with using one or more control lines that may include hydraulic lines, electrical lines, fiber optic bundles, or the like and combination thereof.

Such control lines are currently clamped to the outer surface of the tubular and the sand screens as the completion assembly is being run into the wellbore. Sand screens often include a support channel to house the control lines on the outside of the sand-screen, but this inevitably increases the outer diameter of the sand screen. In order to accommodate the increased outer diameter of the sand screens, oftentimes a larger wellbore needs to be drilled. Otherwise, the inner flow path of the tubular can be made smaller (i.e., smaller pipe in the center of the sand-screen), but this results in reduced hydrocarbon production.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

This present disclosure is related to wellbore operations and, more particularly, to sand control screen assemblies that receive, retain, and protect control lines during installation and operation of the sand control screen assembly.

The present disclosure describes solutions to several problems with the use of sand screens and the fiber optic monitoring in conjunction with sand screens. One or more hydraulic conduits may be arranged between the sand screens and the outer surface of the base pipe to enable pressure monitoring and deployment of optical fibers for distributed temperature monitoring in the sand screens. Advantageously, the conduits are able to pass through multiple screen assemblies in a continuous tubular length, thereby providing an instrumented sand screen with minimum mechanical footprint. Where fiber optic cables are employed, the systems and methods disclosed herein may prove especially advantageous since well operators will be able to install fiber optic monitoring equipment without requiring multiple optical fiber splices at each screen joint or several other locations along a completion assembly, a task that can be quite expensive and time-consuming.

Figure 1:
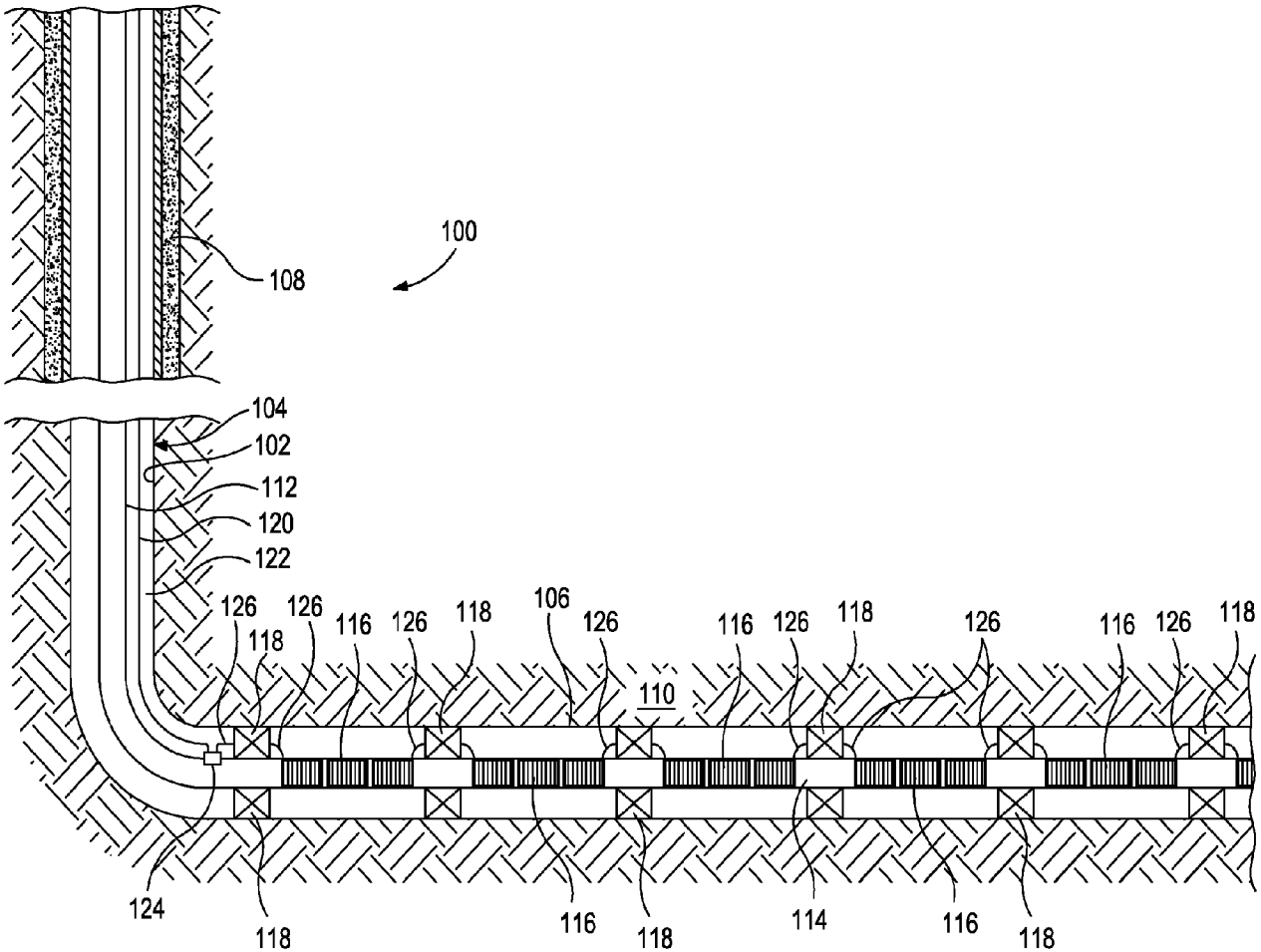
FIG. 1 illustrates a well system that may employ the principles of the present disclosure.

Referring to FIG. 1, illustrated is an exemplary well system 100 which can embody or otherwise employ one or more principles of the present disclosure, according to one or more embodiments. As depicted, the well system 100 includes a wellbore 102 that extends through various earth strata and has a substantially vertical section 104 that transitions into a substantially horizontal section 106. The upper portion of the vertical section 104 may have a liner or casing string 108 cemented therein, and the horizontal section 106 may extend through a hydrocarbon bearing subterranean formation 110. As illustrated, the horizontal section 106 may be arranged within or otherwise extend through an open hole section of the wellbore 102. In other embodiments, however, the horizontal section 106 of the wellbore 102 may be completed, without departing from the scope of the disclosure.

A tubing string 112 may be positioned within the wellbore 102 and extend from the surface (not shown). The tubing string 112 provides a conduit for fluids extracted from the formation 110 to travel to the surface. At its lower end, the tubing string 112 may be coupled to a completion assembly 114 generally arranged within the horizontal section 106. The completion assembly 114 serves to divide the completion interval into various production intervals adjacent the formation 110. As depicted, the completion assembly 114 may include a plurality of sand control screen assemblies 116 axially offset from each other along portions of the completion assembly 114. Each screen assembly 116 may be positioned between a pair of wellbore isolation devices or packers 118 that provides a fluid seal between the completion assembly 114 and the wellbore 102, thereby defining corresponding production intervals. In operation, the screen assemblies 116 serve the primary function of filtering particulate matter out of the production fluid stream such that particulates, sand, and/or other fines are not produced to the surface.

One or more control lines 120 (one shown) may extend from the surface within the annulus 122 defined between the inner wall of the wellbore 102 and the tubing string 112. While not shown in FIG. 1, the control line 120 may be clamped or otherwise secured to the outer surface of the tubing string 112 at various locations along its axial length. The control line 120 is a generally tubular structure capable of providing instructions, carrying power, signals and data, and transporting operating fluids (e.g., hydraulic fluid) to one or more sensors and actuators associated with the screen assemblies 116 and/or other tools or components positioned downhole. Accordingly, the control line 120 may be representative of or otherwise include one or more hydraulic lines, one or more electrical lines, and/or one or more fiber optic lines that extend from the surface external to the tubing string 112. For purposes of the present disclosure, however, the control line 120 may be generally representative of an optical cable encompassing multiple optical fibers extending from the surface. As such, the control line 120 may be configured to facilitate the monitoring of one or more fluid and/or well environment parameters.

Upon reaching the completion assembly 114, the control line 120 may be communicably coupled to a control line housing 124 that is coupled to or otherwise forms an integral part of the tubing string 112. As will be described in greater detail below, in at least one embodiment the control line housing 124 may provide a pressure barrier or container that houses a fiber optic splicing block that provides fiber optic data communication to and from the completion assembly 114. One or more hydraulic conduits 126 (one shown) may extend downhole from the control line housing 124 and through all or a portion of the completion assembly 114. In some embodiments, as illustrated and described in greater detail below, the hydraulic conduits 126 may bypass the packers 118 and extend through the interior of one or more of the screen assemblies 116.

Once the completion assembly 114 is positioned as shown within the wellbore 102, a treatment fluid containing sand, gravel, proppants or the like may be pumped down the completion assembly 114 such that the formation 110 and the several production intervals defined between adjacent packers 118 may be treated. One or more sensors (not shown) operably associated with the completion assembly 114 may be employed to provide substantially real-time data to a well operator via the control lines 120.

Such real-time data may include the effectiveness of the treatment operation, such as identifying voids during the gravel placement process to allow the operator to adjust treatment parameters such as pump rate, proppant concentration, fluid viscosity and the like to overcome deficiencies in the gravel pack. In addition, the sensors associated with the completion assembly 114 may be used to provide valuable information to the operator via the control lines 120 during the production phase of the well such as fluid temperature, pressure, velocity, flow rate, water cut, constituent composition, seismic waves (e.g., flow-induced vibrations), radioactivity and the like such that the well operator can enhance production operations.

It should be noted that even though FIG. 1 depicts the screen assemblies 116 as being arranged in an open hole portion of the wellbore 102, embodiments are contemplated herein where one or more of the screen assemblies 116 is arranged within cased portions of the wellbore 102. Also, even though FIG. 1 depicts single sand screen assemblies 116 having three screen jackets (discussed further in FIG. 2) in each production interval, it should be understood by those skilled in the art that any number of screen assemblies 116, each having any number of screen jackets, may be deployed within a production interval, without departing from the principles of the present invention. In addition, even though FIG. 1 depicts multiple production intervals separated by the packers 118, it will be understood by those skilled in the art that the completion interval may include any number of production intervals with a corresponding number of packers 118 arranged therein. In other embodiments, the packers 118 may be entirely omitted from the completion interval, without departing from the scope of the disclosure.

Further, even though FIG. 1 depicts the screen assemblies 116 as being arranged in a generally horizontal section 106 of the wellbore 102, those skilled in the art will readily recognize that the principles of the present disclosure are equally well suited for use in vertical wells, deviated wellbores, slanted wells, multilateral wells, combinations thereof, and the like. As used herein, directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
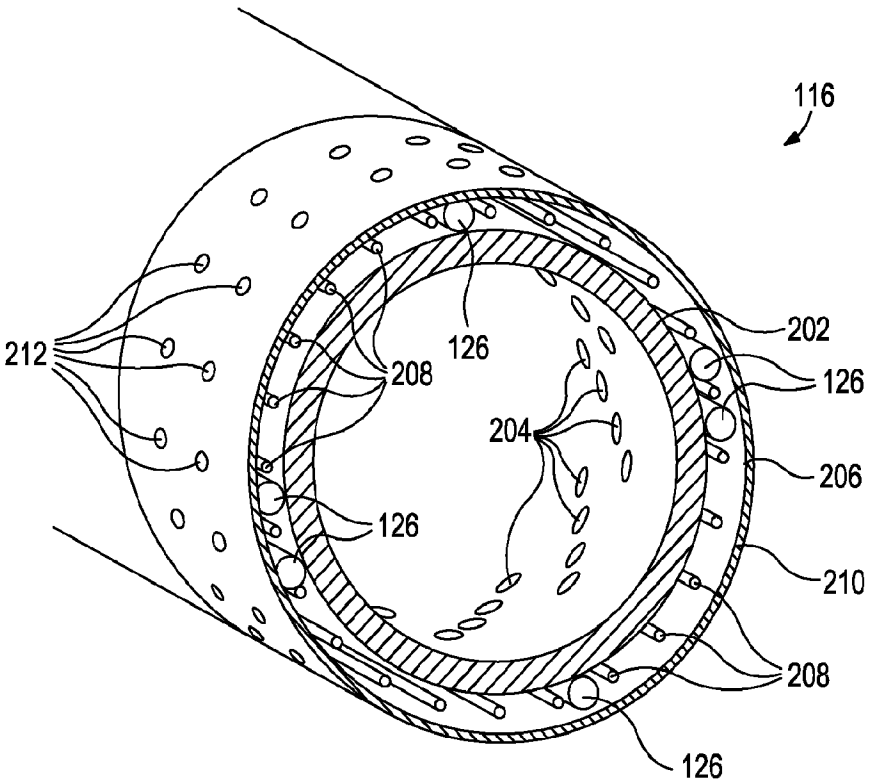
FIG. 2 illustrates a partial cut-away view of an exemplary sand control screen assembly, according to one or more embodiments of the present disclosure.

Referring now to FIG. 2, with continued reference to FIG. 1, illustrated is a partial cut-away view of one of the sand control screen assemblies 116 of FIG. 1, according to one or more embodiments of the present disclosure. Like numerals used in both FIGS. 1 and 2 refer to like elements that will not be described again in detail. The sand control screen assembly 116 may include a base pipe 202 that defines a plurality of openings 204 that allow the flow of production fluids into the base pipe 202. As will be appreciated, the exact number, size, and shape of the openings 204 are not critical to the present disclosure, so long as sufficient area is provided for fluid production and the integrity of the base pipe 202 is maintained.

Positioned around the base pipe 202 may be a fluid-porous, particulate restricting filter medium, such as a plurality of layers of a wire mesh that form a screen 206. A plurality of longitudinal rods or ribs 208 may extend longitudinally between the screen 206 and the outer surface of the base pipe 202 in order to maintain the integrity of the screen 206 and otherwise support the screen 206 during operation. The screen 206 may exhibit a predetermined filter gauge designed to allow fluid flow therethrough but prevent the flow of particulate matter or sand of a predetermined size from passing therethrough. As a result, particulate matter or sand of a particular size or greater will be generally prevented from flowing through the screen 206 and produced to the surface through the base pipe 202.

The screen 206 may be made from of a plurality of layers of a wire mesh that are diffusion bonded or sintered together to form a fluid porous wire mesh screen. In other embodiments, however, the screen 206 may have multiple layers of a weave mesh wire material having a uniform pore structure and a controlled pore size that is determined based upon the properties of the formation 110 (FIG. 1). For example, suitable weave mesh screens may include, but are not limited to, a plain Dutch weave, a twilled Dutch weave, a reverse Dutch weave, combinations thereof, or the like. In yet other embodiments, the screen 206 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure. In at least one embodiment, the screen 206 may be an expandable-type screen.

The screen assembly 116 may further include an outer shroud 210 positioned around the screen 206 and defining a plurality of apertures 212 that allow the flow of production fluids therethrough. As with the openings 204 in the base pipe 202, the exact number, size and shape of the apertures 212 in the shroud 210 are not critical to the present disclosure, so long as sufficient area is provided for fluid production and the integrity of the outer shroud 210 is maintained. Various sections of the screen 206 and the outer shroud 210 may be manufactured together as a unit, and may be characterized as or otherwise referred to herein as a "screen jacket." Accordingly, use of the term "screen jacket" may refer to a combination of one or more screens 206 and one or more outer shrouds 210, but may equally refer to the outer shroud 210 independent of the screen 206. One or several screen jackets may be included in a single screen assembly 116 and may be placed over each joint of the base pipe 202 and secured thereto by welding or other suitable techniques known in the art.

Even though the sand control screen assembly 116 has been depicted and described as having a wire mesh filter medium (e.g., the screen 206), it should be understood by those skilled in the art that the screen assemblies of the present disclosure may use any type of filter media including, but not limited to, a single layer wire wrapped filter medium, a multi-layer wire wrapped filter medium, a pre-packed filter medium or the like that may include or exclude an outer shroud, without departing from the scope of the present disclosure.

The sand control screen assembly 116 may further include one or more hydraulic conduits 126 (six shown) arranged longitudinally within the screen 206 and otherwise interposing the screen 206 and the outer surface of the base pipe 202. The hydraulic conduits 126 may be continuous tubular structures extending along (i.e., within) all or a portion of one or more sand screen assemblies 116. As will be discussed below, some of the hydraulic conduits 126 may be made of one or more tubular lengths coupled together so as to provide a longer overall length. In some embodiments, as illustrated, several individual hydraulic conduits 126 may be arranged about the circumference of the base pipe 202. In other embodiments, however, the hydraulic conduits 126 may be located at a single location about the circumference of the base pipe 202, without departing from the scope of the disclosure.

The hydraulic conduits 126 may be made from a variety of materials. In some embodiments, for example, one or more of the hydraulic conduits 126 may be made of stainless steel, such as 304L stainless steel, 316L stainless steel, 420 stainless steel, or 410 stainless steel. In other embodiments, however, one or more of the hydraulic conduits 126 may be made of other materials such as, but not limited to, 13 chrome, Incoloy 825, AISI 4041 steel, or similar alloys. One or more of the hydraulic conduits 126 may be cylindrical in shape, as depicted in FIG. 2. In other embodiments, however, one or more of the hydraulic conduits 126 may exhibit other shapes, such as ovoid, elliptical, or polygonal (e.g., triangular, square, rectangular, etc.), without departing from the scope of the disclosure. In some embodiments, one or more of the hydraulic conduits 126 may be sized at about ¼ inch in diameter. In other embodiments, however, the hydraulic conduits 126 may be sized greater or less than ¼ inch in diameter, without departing from the scope of the disclosure.

Figure 3:
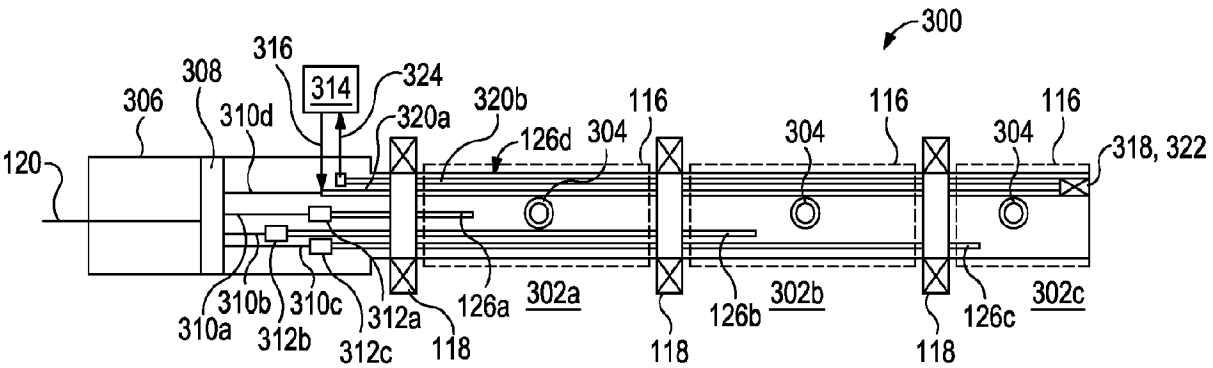
FIG. 3 illustrates a schematic diagram of an exemplary completion assembly, according to one or more embodiments.

Referring now to FIG. 3, with continued reference to FIGS. 1 and 2, illustrated is a schematic diagram of an exemplary completion assembly 300, according to one or more embodiments. The completion assembly 300 may be substantially similar to the completion assembly 114 of FIG. 1 and therefore may be best understood with reference thereto, where like numerals represent like elements not described again in detail. As depicted, the completion assembly 300 may include a plurality of sand control screen assemblies 116 axially offset from each other along portions of the completion assembly 300. Each screen assembly 116 may include one or more screen jackets, as generally described above. Moreover, each screen assembly 116 may be positioned between a pair of wellbore isolation devices or packers 118 that provides a fluid seal between the completion assembly 114 and the wellbore 102 (FIG. 1), thereby defining corresponding production intervals, shown as a first interval 302*a*, a second interval 302*b*, and a third interval 302*c*.

Each screen assembly 116 may further include one or more flow control devices 304. The flow control devices 304 may be any type of flow-regulating device known to those skilled in the art. For example, the flow control devices 304 may include, but are not limited to, an inflow control device, an autonomous inflow control device, a valve (e.g., expandable-type, expansion-type, etc.), a sleeve, a sleeve valve, a sliding sleeve, a flow restrictor, a check valve (operable in either direction, in series or in parallel with other check valves, etc.), combinations thereof, or the like. In operation, the screen assemblies 116 serve to filter particulate matter out of the production fluid stream, and the flow control devices 304 prevent or otherwise restrict fluid flow into the interior of the tubing string 112 (FIG. 1).

The completion assembly 300 may further include, or have associated therewith, a control line housing 306 similar to the control line housing 124 of FIG. 1. The control line housing 306 may be configured to receive the control line 120 that extends from the surface and provide a pressure barrier or container that houses a fiber optic splicing block 308. The fiber optic splicing block 308 may have one or more optical fibers or cables 310 (shown as fiber optic cables 310*a*, 310*b*, 310*c*, and 310*d*) spliced thereto that provide fiber optic data communication to and from various portions of the completion assembly 300.

One or more hydraulic conduits 126 (shown as hydraulic conduits 126*a*, 126*b*, 126*c*, and 126*d*) may extend from the control line housing 306 longitudinally into the completion assembly 300. More particularly, the first hydraulic conduit 126*a* may extend from the control line housing 306 and terminate in the first interval 302*a*, the second hydraulic conduit 126*b* may extend from the control line housing 306 and terminate in the second interval 302*b*, and the third hydraulic conduit 126*c* may extend from the control line housing 306 and terminate in the third interval 302*c*. Each hydraulic conduit 126*a-c* passes through at least one packer 118 and possibly through multiple screen jackets in order to reach its desired location within the corresponding intervals 302*a-c*. Moreover, as described with reference to FIG. 2 above, each of the hydraulic conduits 126*a-d* may be arranged longitudinally within a screen (e.g., screen 206 of FIG. 2) and otherwise interposing the screen and the outer surface of a base pipe (e.g., base pipe 202 of FIG. 2). Accordingly, the hydraulic conduits 126*a-d* may be continuous tubular structures extending along (i.e., within) all or a portion of the screen assembly 300.

In one or more embodiments, the first, second, and third hydraulic conduits 126*a-c* may be used to help measure or otherwise monitor one or more wellbore parameters. More particularly, the first, second, and third hydraulic conduits 126*a-c* may be configured to convey and sense real-time pressures within the first, second, and third intervals 302*a-c*, respectively. To accomplish this, each hydraulic conduit 126*a-c* may be communicably coupled to a pressure sensor or gauge 312 (shown as gauges 312*a*, 312*b*, and 312*c*) arranged within the control line housing 306. The distal end of each hydraulic conduit 126*a-c* may be left open or otherwise exposed to the environment in each interval 302*a-c*, thereby allowing the hydraulic conduits 126*a-c* to provide a fluid pathway for fluid pressures to be conveyed to corresponding pressure gauges 312*a-c*. Accordingly, the first pressure gauge 312*a* may be configured to detect fluid pressure in the first interval 302*a* as propagated through the first hydraulic conduit 126*a*, the second pressure gauge 312*b* may be configured to detect fluid pressure in the second interval 302*b* as propagated through the second hydraulic conduit 126*b*, and the third pressure gauge 312*c* may be configured to detect fluid pressure in the third interval 302*c* as propagated through the third hydraulic conduit 126*c*.

In some embodiments, the pressure gauges 312*a-c* may be any type of pressure gauge known to those skilled in the art. The optical fibers or cables 310*a-c* extend from the corresponding pressure gauges 312*a-c* and are spliced into the fiber optic splicing block 308 such that the detected or measured pressures in each interval 302*a-c* may be communicated to the surface in real-time via the control line 120. In other embodiments, however, the pressure gauges 312*a-c* may be a type of electrical pressure gauge known to those skilled in the art, and the optical cables 310*a-c* may be electrical or electro-optical lines spliced into the splicing block 308 or otherwise extended to the surface such that the detected or measured pressures in each interval 302*a-c* may be communicated to the surface.

As will be appreciated, having the hydraulic conduits 126*a-c* extend into each interval 302*a-c* eliminates the need to individually place the pressure gauges 312*a-c* in each screen assembly 116 to measure pressures in each interval 302*a-c*. Rather, the fluid pressure present in each interval 302*a-c* is able to communicate up each corresponding hydraulic conduit 126*a-c* to the respective pressure gauge 312*a-c* arranged in the control line housing 306. Such a feature will prove advantageous during the construction of the completion assembly 300, which would otherwise require multiple optical fiber splices at each screen joint, packer 118, etc., which can be a fairly expensive and time-consuming process. Moreover, as will be appreciated by those skilled in the art, fiber optic splice housings may also have a large outer diameter which may pose a significant disadvantage in a size-constrained environment. Multiple fiber optic splices may also introduce a larger failure probability when compared with a pre-manufactured cable or pristine optical fiber.

The fourth hydraulic conduit 126*d* may provide a means for measuring or otherwise monitoring other wellbore parameters, such as Distributed Temperature Sensing (DTS) and/or Distributed Acoustic Sensing (DAS) within each interval 302*a-c*. More particularly, the fourth hydraulic conduit 126 may have the fourth fiber optic cable 310*d* disposed therein and extending substantially its entire length and thereby encompassing each of the first, second, and third intervals 302*a-c*. The fiber optic cable 310*d* may have multiple optical fibers where the fibers may be single-mode and/or multi-mode optical fibers.

In some embodiments, the fiber optic cable 310*d* may be hydraulically inserted into the fourth hydraulic conduit 126*d*. To accomplish this, a pump 314 may be fluidly coupled to the fourth hydraulic conduit 126*d* and configured to convey a fluid 316 into the fourth hydraulic conduit 126*d* while the fiber optic cable 310*d* is simultaneously being fed therein. A distributed drag force generated by the fluid 316 acts on and impels the fiber optic cable 310*d* to the distal end of the fourth hydraulic conduit 126*d*. A check valve 318 may be arranged at the distal end of the fourth hydraulic conduit 126*d* and configured to allow the fluid 316 to exit the distal end of the fourth conduit 216*d* but prevent the pumped fiber optic cable 310*d* from advancing any further and escaping. The check valve 318 may also maintain a pressure seal at the end of the fourth conduit 216*d* during operation.

In other embodiments, the fourth hydraulic conduit 126*d* may be a dual ended conduit including a deployment conduit 320*a* and a return conduit 320*b*. In such an embodiment, the check valve 318 may be replaced with a turnaround sub 322 that interposes the deployment and return conduits 320*a,b* and otherwise provides a fluid connection between the two conduits 320*a,b*. The pump 314 conveys the fluid 316 into the deployment conduit 320*a* while the fiber optic cable 310*d* is simultaneously fed therein. At the turnaround sub 322, the fluid 316 makes a U-turn and returns to the pump 314 via the return conduit 320*b* and a return line 324 fluidly coupled to the pump 314. Again, the fluid 316 imparts a distributed drag force on the fiber optic cable 310*d* that tends to impel and advance the fiber optic cable 310*d* to the distal end of the deployment conduit 320*a*. The turnaround sub 322 receives the fiber optic cable 310*d* and generally stops its axial progress.

Once the fiber optic cable 310*d* is extended within the fourth hydraulic conduit 126*d* (using either method described above), the fiber optic cable 310*d* may be secured within the fourth hydraulic conduit 126*d* using, for example a Swagelok-type coupling or the like. In some embodiments, the fiber optic cable 310*d* may be pre-manufactured with a fiber optic connector (not shown) at its end. The fiber optic connector may include a pressure barrier to mitigate fluid communication in case the fiber optic cable 310*d* is breached. The fiber optic cable 310*d* may then be spliced into the fiber optic splicing block 308 such that the detected or measured temperatures or acoustic signals along the entire completion assembly 300 and in each interval 302*a-c* may be communicated to the surface via the optical fibers in the control line 120. Accordingly, in exemplary operation, the fourth fiber optic cable 310 and the fourth hydraulic conduit 126*d* and may provide distributed temperature sensing (DTS) and/or distributed acoustic sensing (DAS) along the length of the completion assembly 300.

The fiber optic splicing block 308 may be configured to receive the fiber optic cables 310*a-d* and channel them into a single optical cable (i.e., the control line 120) consisting of several optical fibers. The fiber optic splicing block 308 may further include suitable pressure barriers used to prevent fluid communication in case any of the components located downhole therefrom is mechanically breached. In some embodiments, as mentioned above, the control line 120 may extend to the surface. In other embodiments, however, the control line 120 may extend to another completion assembly arranged uphole from the completion assembly 300 of FIG. 3. In such embodiments, the control line 120 may be communicably coupled to the other completion assembly using, for example, a down-hole fiber optic wet-connect.

Figure 4:
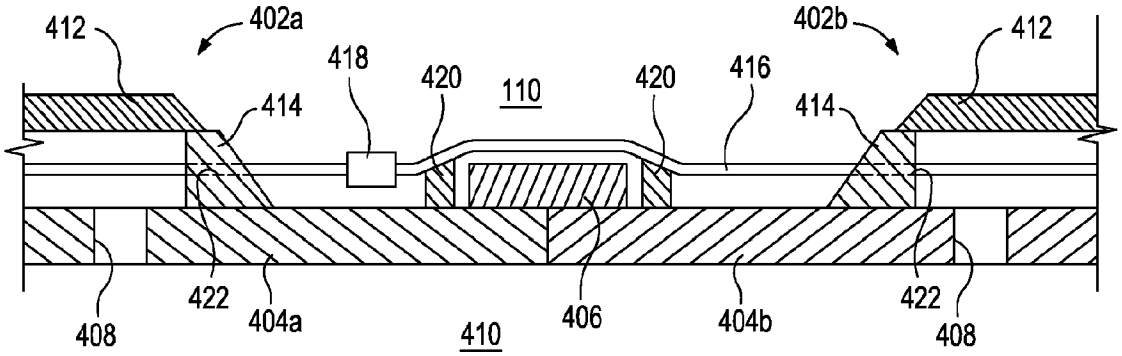
FIG. 4 illustrates is a cross-sectional view of adjacent sand control screen assemblies, according to one or more embodiments.

Referring now to FIG. 4, with continued reference to FIGS. 2 and 3, illustrated is a cross-sectional view of adjacent sand control screen assemblies, according to one or more embodiments. More particularly, illustrated is a first sand control screen assembly 402*a* arranged axially uphole (i.e., to the left in FIG. 4) from a second sand control screen assembly 402*b*. The first and second screen assemblies may 402*a,b* be similar in some respects to the screen assemblies 116 of FIGS. 2 and 3, and therefore may be best understood with reference thereto.

The screen assemblies 402*a,b* may be arranged about a base pipe 404, which may include an elongate section of pipe, or may be split up into two or more portions, such as base pipe portions 404*a* and 404*b* (collectively "base pipe 404"). For instance, as illustrated, the first screen assembly 402*a* may be generally arranged about a first base pipe 404*a*, and the second screen assembly 402*b* may be generally arranged about a second base pipe 404*b*. The first and second base pipes 404*a,b* may be coupled together using a base pipe coupling 406. In some embodiments, the base pipe coupling 406 is a threaded ring configured to receive corresponding threaded ends of each of the first and second base pipes 404*a,b* in order to couple the base pipes 404*a,b* together. In other embodiments, however, the base pipe coupling 406 may be a threaded box end coupling for either of the first or second base pipes 404*a,b* configured to receive a correspondingly threaded pin end of the other of the first or second base pipes 404*a,b*.

The base pipe 404 may further define one or more perforations or openings 408 configured to provide fluid communication between the interior 410 of the base pipe 404 and the formation 110. Each screen assembly 402*a,b* may further include a screen jacket 412 arranged about the exterior of the base pipe 404. One or both of the screen jackets 412 may include a screen filter (e.g., the screen 206 of FIG. 2) and an outer shroud (e.g., shroud 210 of FIG. 2). In other embodiments, however, one or both of the screen jackets may include only the screen filter or only the outer shroud, without departing from the scope of the disclosure. In operation, the screen jackets 412 may serve as a filter medium designed to allow fluids derived from the surrounding formation 110 to flow therethrough but prevent the influx of particulate matter of a predetermined size.

Each screen jacket 412 may be secured to the base pipe 404 using end rings 414 arranged at each end of the screen jacket 412. The end rings 414 provide a mechanical interface between the base pipe 404 and the opposing ends of the screen jackets 412. In some embodiments, one or both of the end rings 414 may be shrink rings. Each end ring 414 may be formed from a metal such as 13 chrome, 304L stainless steel, 316L stainless steel, 420 stainless steel, 410 stainless steel, Incoloy 825, or similar alloys. Moreover, each end ring 414 may be coupled or otherwise attached to the outer surface of base pipe 404 by being welded, brazed, threaded, combinations thereof, or the like. In other embodiments, however, one or more of the end rings 414 may be an integral part of the corresponding screen jacket 412, and not a separate component thereof.

As illustrated, a hydraulic conduit 416 may extend through at least a portion of each of the first and second screen assemblies 402*a,b*. More particularly, the hydraulic conduit 416 may extend through the first and second screen assemblies 402*a,b* between the screen jacket 412 and the outer surface of the base pipe 404. The hydraulic conduit 416 may be similar to the hydraulic conduits 126 of FIGS. 2 and 3 and therefore will not be described again in detail. Opposing ends of the hydraulic conduit 416 may be coupled together at one or more conduit couplings 418. The conduit coupling 418 provides a sealed interface that fluidly connects the opposing ends of the hydraulic conduit 416 such that the overall length of the hydraulic conduit 416 may be extended. In some embodiments, the hydraulic conduit 416 may be clamped to the outer surface of the base pipe 404 between the screen assemblies 402*a,b*. For instance, one or more cross coupling protectors 420 may be used to protect the hydraulic conduit 416 as it crosses over the base pipe coupling 406.

Each end ring 414 may define a hole 422 configured to receive and otherwise secure the hydraulic conduit 416 therein as the hydraulic conduit 416 passes into and out of each screen assembly 402*a,b*. As described below, the hydraulic conduit 416 may be secured within the hole 422 using one or more mechanical fasteners (not shown in FIG. 4) configured to clamp and/or substantially seal an interface between the hole 422 and the hydraulic conduit 416. In other embodiments, however, the hydraulic conduit 416 may be arranged in the hole 422 with an interference fit such that particulate matter or sand of a predetermined size and greater is prevented from passing into the screen assemblies 402*a,b* via the hole 422.

Figure 5A:
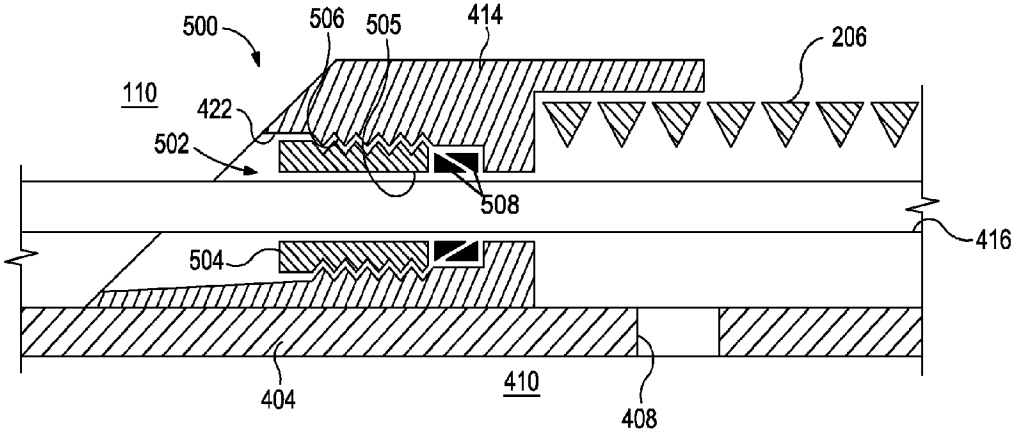
FIGS. 5A-5C illustrate cross-sectional views of a portion of a sand control screen assembly, according to one or more embodiments of the present disclosure.
Figure 5B:
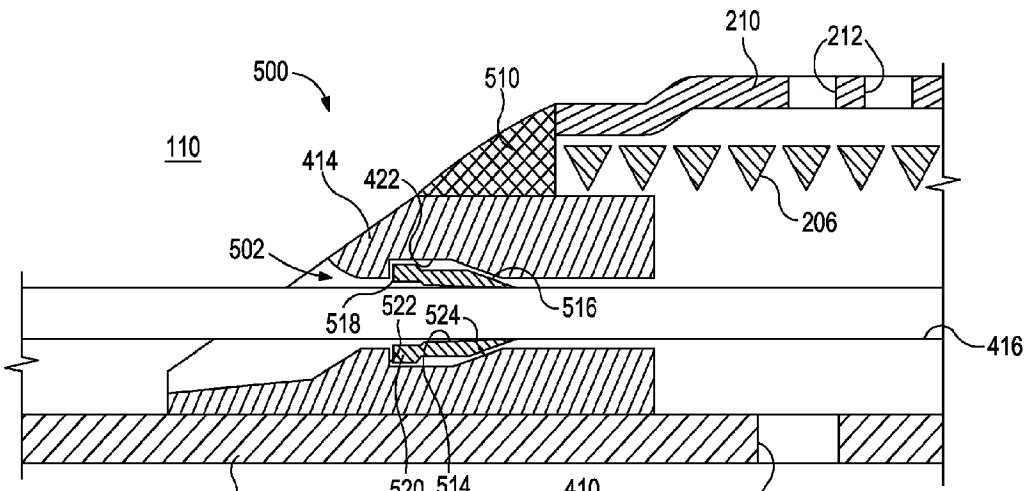
Figure 5C:
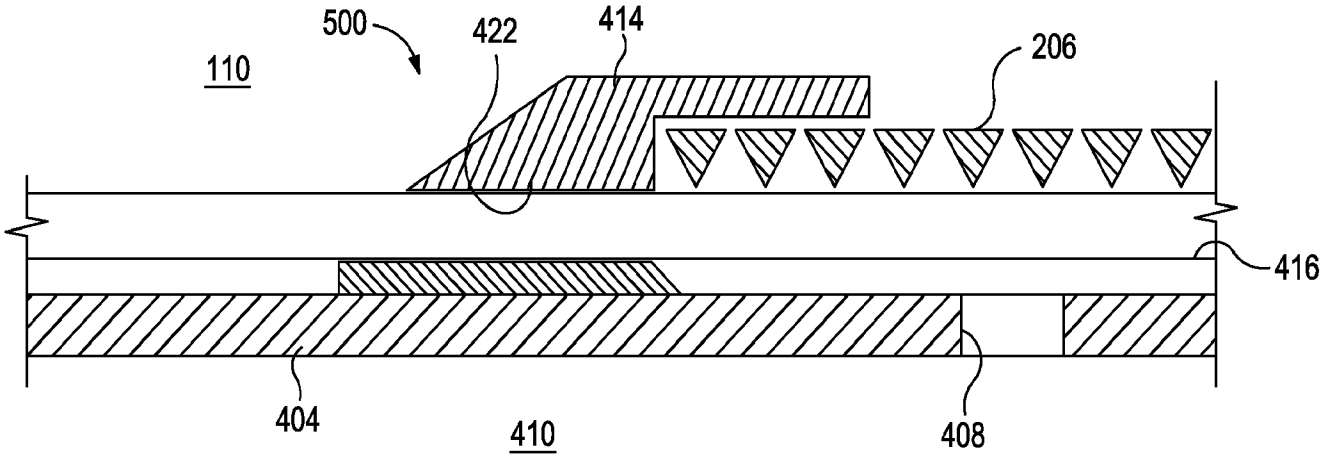

Referring now to FIGS. 5A-5C, with continued reference to FIG. 4, illustrated are cross-sectional views of a portion of a sand control screen assembly 500, according to one or more embodiments of the present disclosure. The sand control screen assembly 500 may be similar in some respects to the screen assemblies 116 and 402*a,b* of FIGS. 2 and 4, respectively, and therefore may be best understood with reference thereto, where like numerals represent like components not described again in detail. In FIG. 5A, as illustrated, the hydraulic conduit 416 extends into the screen assembly 500 via the hole 422 defined in the end ring 414. In the illustrated embodiment, the screen assembly 500 includes a screen 206 and the hydraulic conduit 416 extends within the screen assembly 500 generally interposing the screen 206 and the outer surface of the base pipe 404.

The screen assembly 500 may further include a mechanical fastener 502 configured to generally secure the hydraulic conduit 416 within the hole 422. As illustrated, the mechanical fastener 502 may be a Swagelok-type fastener. More particularly, the mechanical fastener 502 may include a threaded nut 504 configured to threadably engage corresponding threads 506 defined on the inner surface of the hole 422. The nut 504 may define a central channel 505 configured to longitudinally receive the hydraulic conduit 416 therein. The mechanical fastener 502 may further include a pair of compression ferrule rings 508. 508 As the nut 504 is threadably advanced into the hole 422, the rings 508 are compressed against their opposing beveled surfaces and simultaneously forced into sealing engagement with the outer surface of the hydraulic conduit 416 and the inner surface of the hole 422. As a result, the mechanical fastener 502 may create a substantially sealed interface at the end ring 414 such that particulate matter or sand is prevented from entering into the screen assembly 500 through the hole 422. Accordingly, the mechanical fastener 502 may seal and mechanically fasten the hydraulic conduit 416 within the hole 422.

Referring to FIG. 5B, the screen assembly 500 may include the screen 206 and an outer shroud 210 arranged about the screen 206 (i.e., a screen jacket). As described above, the openings 212 in the outer shroud 210 provide fluid communication between the formation 110 and the interior of the screen assembly 500. In at least one embodiment, one or both of the screen 206 and the outer shroud 210 may be welded 510 to the end ring 414.

The mechanical fastener 502 depicted in FIG. 5B may be in the form of an annular wedge. More particularly, the mechanical fastener 502 may include a central conduit 514 configured to longitudinally receive the hydraulic conduit 416 therein. One end of the mechanical fastener 502 may be tapered and otherwise define a tapered surface 516. The opposing end of the mechanical fastener 502 may define a jarring surface 518 and an annular protrusion 520. To install the mechanical fastener 502, and thereby secure the hydraulic conduit 416 within the hole 422, the jarring surface 518 may be struck with a hammer or other blunt object until the annular protrusion 520 is forced past an annular shoulder 522 defined by the end ring 414 within the hole 422.

Continued movement of the mechanical fastener 502 in the same direction may force the tapered surface 516 into contact with a corresponding tapered surface 524 defined by the hole 422. Mutual engagement between the tapered surfaces 516 and 524 may force the mechanical fastener 502 to clamp down on the hydraulic conduit 416 such that the hydraulic conduit 416 is secured within the end ring 414, but may also substantially seal the interface such that particulate matter or sand is prevented from entering into the screen assembly 500 through the hole 422.

In some embodiments, the mechanical fastener 502 may be a collet and the annular protrusion 520 may be defined on axially extending fingers that are able to flex into the hole 422 past the shoulder 522 and thereafter snap into place. In other embodiments, the shoulder 522 may be omitted and the mechanical fastener 502 may instead be welded into place once arranged at a desired location within the hole 422.

Referring to FIG. 5C, the hydraulic conduit 416 extends into the screen assembly 500 via the hole 422 defined in the end ring 414 and generally interposing the screen 206 and the outer surface of the base pipe 404. In the illustrated embodiment, the hydraulic conduit 416 may be secured to the end ring 414 without the aid of a mechanical fastener (e.g., mechanical fastener 502 of FIGS. 5A and 5B). Rather, the end ring 414 may be a shrink ring configured to provide an interference fit for the hydraulic conduit 416 within the hole 422. In some embodiments, the end ring 414 may be heated so that the size of the hole 422 increases and allows the hydraulic conduit 416 to be freely extended therein. Upon cooling, the size of the hole 422 will decrease and the hole 422 may sealingly engage the outer surface of the hydraulic conduit 416 and thereby securing the conduit.

In other embodiments, however, the hole 422 may be sized such that the hydraulic conduit 416 may be extended therethrough without an interference fit. Rather, any remaining gap defined between the inner surface of the hole 422 and the outer surface of the hydraulic conduit 416 may be designed to be gauged less than or equal to the gauge of the screen 206. As a result, particulate matter or sand of a predetermined size or greater will nonetheless be prevented from entering the screen assembly 500 via the hole 422.

Embodiments disclosed herein include:

(A) A completion assembly that may include a base pipe, at least one screen jacket positioned around the base pipe and operable to prevent an influx of particulate matter of a predetermined size therethrough, and a control line housing arranged uphole from the at least one screen jacket and having a fiber optic splicing block disposed therein, the at least one fiber optic splicing block being communicably coupled to a control line that extends uphole from the control line housing. The completion assembly may further include one or more hydraulic conduits arranged longitudinally between the at least one screen jacket and the base pipe and extending from the control line housing.

(B) A method that may include introducing a completion assembly into a wellbore that penetrates a formation. The completion assembly may include at least one screen jacket positioned around a base pipe, a control line housing arranged uphole from the at least one screen jacket and having a fiber optic splicing block disposed therein, and one or more hydraulic conduits arranged longitudinally between the at least one screen jacket and the base pipe and extending from the control line housing. The method may further include measuring one or more wellbore parameters with the one or more hydraulic conduits.

Each of embodiments A and B may have one or more of the following additional elements in any combination:

Element 1: the one or more hydraulic conduits are elongate tubulars in the shape of at least one of cylindrical, ovoid, elliptical, and polygonal.

Element 2: the at least one screen jacket comprises at least a first screen jacket arranged adjacent a first interval of a formation and the one or more hydraulic conduits comprise at least a first hydraulic conduit terminating in the first interval, and wherein the first hydraulic conduit is an open-ended tubular exposed to the first interval and able to convey fluid pressure from the first interval to the control line housing, the completion assembly further comprising a first pressure gauge arranged within the control line housing and being communicably coupled to the first hydraulic conduit, the first pressure gauge being configured to sense fluid pressure in the first interval via the first hydraulic conduit, and a first fiber optic cable communicably coupling the first pressure gauge to the fiber optic splicing block.

Element 3: the at least one screen jacket further comprises a second screen jacket arranged adjacent a second interval of the formation and the one or more hydraulic conduits further comprise a second hydraulic conduit terminating in the second interval, and wherein the second hydraulic conduit is an open-ended tubular exposed to the second interval and able to convey fluid pressure from the second interval to the control line housing, the completion assembly further comprising a second pressure gauge arranged within the control line housing and being communicably coupled to the second hydraulic conduit, the second pressure gauge being configured to sense fluid pressure in the second interval via the second hydraulic conduit, and a second fiber optic cable communicably coupling the second pressure gauge to the fiber optic splicing block.

Element 4: the at least one screen jacket comprises a plurality of screen jackets arranged adjacent one or more intervals of a formation and the one or more hydraulic conduits comprises a first hydraulic conduit that extends through the plurality of screen jackets and across the one or more intervals, the completion assembly further comprising a fiber optic cable hydraulically inserted into the first hydraulic conduit and communicably coupled to the fiber optic splicing block, the fiber optic cable being configured to sense and convey distributed temperature and/or acoustic information across the one or more intervals to the fiber optic splicing block.

Element 5: the first hydraulic conduit comprises a deployment conduit configured to receive the fiber optic cable as it is hydraulically advanced therein with a fluid pumped from a pump, a return conduit fluidly coupled to the deployment conduit and extending parallel thereto, the deployment conduit being configured to return the fluid to the pump, and a turnaround sub fluidly interposing the deployment and return conduits.

Element 6: further comprising a check valve arranged at a distal end of the first hydraulic conduit.

Element 7: further comprising at least one end ring securing the at least one screen jacket to the base pipe and defining a hole therein to receive the one or more hydraulic conduits.

Element 7: the one or more hydraulic conduits are secured within the hole via an interference fit.

Element 8: further comprising a mechanical fastener arranged in the hole and configured to secure the one or more hydraulic conduits therein.

Element 9: the mechanical fastener is one of a Swagelok-type fastener or an annular wedge-type fastener.

Element 10: the at least one screen jacket comprises at least a first screen jacket arranged adjacent a first interval of the formation and the one or more hydraulic conduits comprise at least a first hydraulic conduit terminating in the first interval, and wherein measuring the one or more wellbore parameters with the one or more hydraulic conduits comprises conveying fluid pressure from the first interval to the control line housing, wherein the first hydraulic conduit is an open-ended tubular exposed to the first interval and the fluid pressure from the first interval is at least one of the one or more wellbore parameters, sensing the fluid pressure in the first interval with a first pressure gauge arranged within the control line housing and communicably coupled to the first hydraulic conduit, and transmitting the fluid pressure in the first interval to the fiber optic splicing block via a first fiber optic cable that communicably couples the first pressure gauge to the fiber optic splicing block.

Element 11: the at least one screen jacket further comprises a second screen jacket arranged adjacent a second interval of the formation and the one or more hydraulic conduits further comprise a second hydraulic conduit terminating in the second interval, the method further comprising, conveying fluid pressure from the second interval to the control line housing, wherein the second hydraulic conduit is an open-ended tubular exposed to the second interval and the fluid pressure from the second interval is at least one of the one or more wellbore parameters, sensing the fluid pressure in the second interval with a second pressure gauge arranged within the control line housing and communicably coupled to the second hydraulic conduit, and transmitting the fluid pressure in the second interval to the fiber optic splicing block via a second fiber optic cable that communicably couples the second pressure gauge to the fiber optic splicing block.

Element 12: the at least one screen jacket comprises a plurality of screen jackets arranged adjacent one or more intervals of the formation and the one or more hydraulic conduits comprises a first hydraulic conduit extending through the plurality of screen jackets and across the one or more intervals, wherein measuring the one or more wellbore parameters with the one or more hydraulic conduits comprises sensing distributed temperature and/or acoustic information across the one or more intervals with a fiber optic cable hydraulically inserted into the first hydraulic conduit, wherein the distributed temperature and/or acoustic information is at least one of the one or more wellbore parameters, and conveying the distributed temperature and/or acoustic information to the fiber optic splicing block via the fiber optic cable as communicably coupled to the fiber optic splicing block.

Element 13: the first hydraulic conduit comprises a deployment conduit and a return conduit, the method further comprising receiving the fiber optic cable in the deployment conduit as the fiber optic cable is hydraulically advanced therein with a fluid pumped from a pump, and returning the fluid to the pump with the return conduit fluidly coupled to the deployment conduit and extending parallel thereto, wherein a turnaround sub fluidly interposes the deployment and return conduits.

Element 14: further comprising securing the at least one screen jacket to the base pipe with at least one end ring, and receiving the one or more hydraulic conduits in a hole defined in the at least one end ring.

Element 15: further comprising securing the one or more hydraulic conduits within the hole via an interference fit.

Element 16: further comprising securing the one or more hydraulic conduits within the hole via a mechanical fastener arranged in the hole.

Element 17: further comprising transmitting the one or more wellbore parameters to a surface location with a control line communicably coupled to the fiber optic splicing block.

Element 18: further comprising transmitting the one or more wellbore parameters to a second completion assembly with a control line communicably coupled to the fiber optic splicing block.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A completion assembly, comprising:

a base pipe;

at least one screen jacket positioned around the base pipe and operable to prevent an influx of particulate matter of a predetermined size therethrough;

a control line housing arranged uphole from the at least one screen jacket and receiving a control line that extends uphole from the control line housing, wherein the control line houses one or more optical fibers;

a fiber optic splicing block disposed within the control line housing and having the one or more optical fibers of the control line spliced thereto; and one or more open-ended hydraulic conduits arranged longitudinally between the at least one screen jacket and the base pipe and extending from the control line housing.

2. The completion assembly of claim 1, wherein the one or more open-ended hydraulic conduits are elongate tubulars in the shape of at least one of cylindrical, ovoid, elliptical, and polygonal.

3. The completion assembly of claim 1, wherein the at least one screen jacket comprises a first screen jacket arranged adjacent a first interval of a formation and the one or more open-ended hydraulic conduits comprise a first open-ended hydraulic conduit terminating in the first interval, and wherein the first open-ended hydraulic conduit is exposed to the first interval to convey fluid pressure from the first interval to the control line housing, the completion assembly further comprising:

a first pressure gauge arranged within the control line housing and being communicably coupled to the first open-ended hydraulic conduit, the first pressure gauge being configured to sense fluid pressure in the first interval via the first open-ended hydraulic conduit; and a first fiber optic cable communicably coupling the first pressure gauge to the fiber optic splicing block.

4. The completion assembly of claim 3, wherein the at least one screen jacket further comprises a second screen jacket arranged adjacent a second interval of the formation and the one or more open-ended hydraulic conduits further comprise a second open-ended hydraulic conduit terminating in the second interval, and wherein the second open-ended hydraulic conduit is exposed to the second interval to convey fluid pressure from the second interval to the control line housing, the completion assembly further comprising:

a second pressure gauge arranged within the control line housing and being communicably coupled to the second open-ended hydraulic conduit, the second pressure gauge being configured to sense fluid pressure in the second interval via the second open-ended hydraulic conduit; and a second fiber optic cable communicably coupling the second pressure gauge to the fiber optic splicing block.

5. The completion assembly of claim 1, wherein the at least one screen jacket comprises a plurality of screen jackets arranged adjacent one or more intervals of a formation, the completion assembly further comprises a sealed hydraulic conduit that extends through the plurality of screen jackets and across the one or more intervals, wherein a fiber optic cable is hydraulically inserted into the sealed hydraulic conduit and communicably coupled to the fiber optic splicing block, the fiber optic cable being configured to sense and convey distributed temperature and/or acoustic information across the one or more intervals to the fiber optic splicing block.

6. The completion assembly of claim 5, wherein the sealed hydraulic conduit comprises:

a deployment conduit configured to receive the fiber optic cable as it is hydraulically advanced therein with a fluid pumped from a pump;

a return conduit fluidly coupled to the deployment conduit and extending parallel thereto, the deployment conduit being configured to return the fluid to the pump; and a turnaround sub fluidly interposing the deployment and return conduits.

7. The completion assembly of claim 5, further comprising a check valve arranged at a distal end of the first sealed hydraulic conduit.

8. The completion assembly of claim 1, further comprising at least one end ring securing the at least one screen jacket to the base pipe and defining a hole therein to receive the one or more open-ended hydraulic conduits.

9. The completion assembly of claim 8, wherein the one or more open-ended hydraulic conduits are secured within the hole via an interference fit.

10. The completion assembly of claim 8, further comprising a mechanical fastener arranged in the hole and configured to secure the one or more open-ended hydraulic conduits therein.

11. The completion assembly of claim 10, wherein the mechanical fastener is one of a Swagelok-type fastener or an annular wedge-type fastener.

12. A method, comprising:

introducing a completion assembly into a wellbore that penetrates a formation, the completion assembly including:

at least one screen jacket positioned around a base pipe;

a control line housing arranged uphole from the at least one screen jacket and receiving a control line that extends uphole from the control line housing, wherein the control line houses one or more optical fibers;

a fiber optic splicing block disposed within the control line housing and having the one or more optical fibers spliced thereto; and one or more open-ended hydraulic conduits arranged longitudinally between the at least one screen jacket and the base pipe and extending from the control line housing; and measuring one or more wellbore parameters with the one or more open-ended hydraulic conduits.

13. The method of claim 12, wherein the at least one screen jacket comprises a first screen jacket arranged adjacent a first interval of the formation and the one or more open-ended hydraulic conduits comprise a first open-ended hydraulic conduit terminating in the first interval, and wherein measuring the one or more wellbore parameters with the one or more open-ended hydraulic conduits comprises:

conveying fluid pressure from the first interval to the control line housing, wherein the first open-ended hydraulic conduit is exposed to the first interval;

sensing the fluid pressure in the first interval with a first pressure gauge arranged within the control line housing and communicably coupled to the first open-ended hydraulic conduit; and transmitting the fluid pressure in the first interval to the fiber optic splicing block via a first fiber optic cable that communicably couples the first pressure gauge to the fiber optic splicing block.

14. The method of claim 13, wherein the at least one screen jacket further comprises a second screen jacket arranged adjacent a second interval of the formation and the one or more open-ended hydraulic conduits further comprise a second open-ended hydraulic conduit terminating in the second interval, the method further comprising:

conveying fluid pressure from the second interval to the control line housing, wherein the second hydraulic conduit is exposed to the second interval;

sensing the fluid pressure in the second interval with a second pressure gauge arranged within the control line housing and communicably coupled to the second open-ended hydraulic conduit; and transmitting the fluid pressure in the second interval to the fiber optic splicing block via a second fiber optic cable that communicably couples the second pressure gauge to the fiber optic splicing block.

15. The method of claim 12, wherein the at least one screen jacket comprises a plurality of screen jackets arranged adjacent one or more intervals of the formation and the completion assembly further includes a sealed hydraulic conduit extending through the plurality of screen jackets and across the one or more intervals, the method further comprising:

sensing distributed temperature and/or acoustic information across the one or more intervals with a fiber optic cable hydraulically inserted into the first sealed hydraulic conduit; and conveying the distributed temperature and/or acoustic information to the fiber optic splicing block via the fiber optic cable as communicably coupled to the fiber optic splicing block.

16. The method of claim 15, wherein the sealed hydraulic conduit comprises a deployment conduit and a return conduit, the method further comprising:

receiving the fiber optic cable in the deployment conduit as the fiber optic cable is hydraulically advanced therein with a fluid pumped from a pump; and returning the fluid to the pump with the return conduit fluidly coupled to the deployment conduit and extending parallel thereto, wherein a turnaround sub fluidly interposes the deployment and return conduits.

17. The method of claim 12, further comprising:

securing the at least one screen jacket to the base pipe with at least one end ring; and receiving the one or more open-ended hydraulic conduits in a hole defined in the at least one end ring.

18. The method of claim 17, further comprising securing the one or more open-ended hydraulic conduits within the hole via an interference fit.

19. The method of claim 17, further comprising securing the one or more open-ended hydraulic conduits within the hole via a mechanical fastener arranged in the hole.

20. The method of claim 12, further comprising transmitting the one or more wellbore parameters to a surface location with the control line communicably coupled to the fiber optic splicing block.

21. The method of claim 12, further comprising transmitting the one or more wellbore parameters to a second completion assembly with the control line communicably coupled to the fiber optic splicing block.

* * * * *